US006742691B2

(12) United States Patent
Chen

(10) Patent No.: US 6,742,691 B2
(45) Date of Patent: Jun. 1, 2004

(54) NAIL STAPLER

(76) Inventor: Mu-Yu Chen, No. 78, Ta Tun 17th Street, Hsi Tun District, Taichung (TW)

( * ) Notice: Subject to any disclaimer, the term of this patent is extended or adjusted under 35 U.S.C. 154(b) by 0 days.

(21) Appl. No.: 10/227,373

(22) Filed: Aug. 23, 2002

(65) Prior Publication Data

US 2004/0035905 A1 Feb. 26, 2004

(51) Int. Cl.[7] ..... B25C 1/00
(52) U.S. Cl. ..... 227/120; 227/131; 173/211
(58) Field of Search ..... 227/8, 121, 131, 227/132, 134, 146, 120; 173/211

(56) References Cited

U.S. PATENT DOCUMENTS 3,325,074 A * 6/1967 Batliner et al. ..... 227/8
3,434,026 A * 3/1969 Doyle ..... 318/125
4,515,303 A * 5/1985 Schadlich et al. ..... 227/131
4,573,621 A * 3/1986 Merkator et al. ..... 227/8
4,778,094 A * 10/1988 Fishback ..... 227/66
4,946,087 A * 8/1990 Wingert ..... 227/131
5,025,971 A * 6/1991 Schafer et al. ..... 227/156
5,098,004 A * 3/1992 Kerrigan ..... 227/134
6,145,727 A * 11/2000 Mukoyama et al. ..... 227/130
6,364,193 B1 * 4/2002 Tsai ..... 227/131

* cited by examiner

*Primary Examiner*—Rinaldi I. Rada
*Assistant Examiner*—Paul Durand
(74) *Attorney, Agent, or Firm*—Alan D. Kamrath; Nikolai & Merserau, P.A.

(57) ABSTRACT

A nail stapler includes a gun and a magazine for receiving and supplying staple nails to the gun. The gun includes a shell, a solenoid received in the shell, a puncher received in the shell for movement from an original position to a punching position due to attraction by the solenoid, a pin secured to the puncher and inserted through the solenoid, a spring compressed between a portion of the solenoid and a portion of the puncher, and a security device received in the shell for buffering the puncher when the puncher is pushed from the punching position to the original position by the spring. The security device includes an elastic end for contact with the puncher. The nail elastic end of the security device includes a plurality of elastic elements. The puncher defines a cavity with a wall for contact with the elastic elements. The shell includes two halves each including a retainer formed on an internal face. The security device defines a groove for receiving the retainers of the halves of the shell.

16 Claims, 6 Drawing Sheets

NAIL STAPLER

BACKGROUND OF INVENTION

1. Field of Invention

The present invention relates to a nail stapler.

2. Related Prior Art

Referring to FIGS. 5 and 6, a conventional nail stapler includes a gun 10 and a magazine 16. The gun 10 includes a shell 11, a solenoid 12 received in the shell 11, a puncher 13 received in the shell 11, a spring 14 compressed between an end of the solenoid 12 and a head of the puncher 13 and a pin 15 secured to the puncher 13. When activated, the solenoid 12 attracts the puncher 13 and therefore the pin 15 in order to punch a staple nail 17 from the magazine 16 through an outlet 18. When the magnetic force is gone, the puncher 13 resumes its original position due to the spring 14 as shown in FIG. 5. However, the puncher 13 may hit and rebound from a portion of the shell 11 so as to punch a staple by mistake as shown in FIG. 6.

The present invention is therefore intended to obviate or at least alleviate the problems encountered in the prior art.

SUMMARY OF INVENTION

It is the primary objective of the present invention to provide a nail stapler with a security device for preventing stapling by mistake.

According to the present invention, a nail stapler includes a gun and a magazine for receiving and supplying staple nails to the gun. The gun includes a shell, a solenoid received in the shell, a puncher received in the shell for movement from an original position to a punching position due to attraction by the solenoid, a pin secured to the puncher and inserted through the solenoid, a spring compressed between a portion of the solenoid and a portion of the puncher, and a security device received in the shell for buffering the puncher when the puncher is pushed from the punching position to the original position by the spring.

The security device includes an elastic end for contact with the puncher.

The nail elastic end of the security device includes a plurality of elastic elements. The puncher defines a cavity with a wall for contact with the elastic elements.

The shell includes two halves each with a retainer formed on an internal face. The security device defines a groove for receiving the retainers of the halves of the shell.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
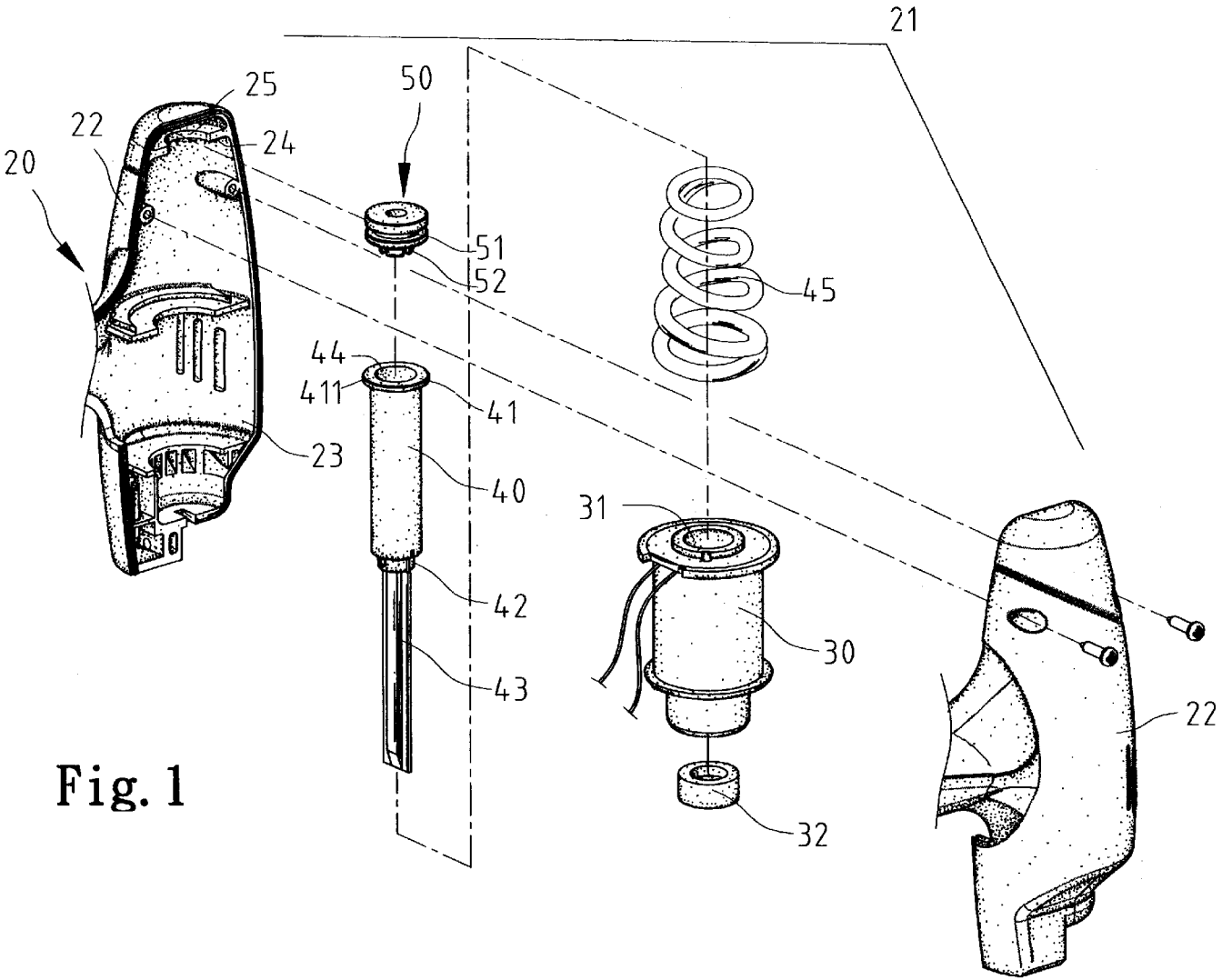
FIG. 1 is an exploded view of a nail stapler according to the present invention.

Referring to FIGS. 1–4, according to the present invention, a nail stapler includes a gun 20 (partially shown) and a magazine 27.

The gun 20 includes a shell 21, a solenoid 30, a puncher 40 and a security device 50.

The shell 21 consists of two halves 22 and defines a space 23. A retainer 24 is formed on an internal face of each of the halves 22 of the shell 21. The retainer 24 defines a semicircular recess 25.

The solenoid 30 defines an axial channel 31. The solenoid 30 is received in the shell 21. A pad 32 is positioned between the solenoid 30 and a portion of the shell 21.

The puncher 40 includes a first end 41 and a second end 42. The first end 41 of the puncher 40 is formed as an enlarged head 411. A cavity 44 is defined in the first end 41. A pin 43 is secured to the second end 42 of the puncher 40. The pin 43 is inserted through a space surrounded by the spring 45 and the axial channel 31 of the solenoid 30. The puncher 40 is inserted through the space surrounded by the spring 45. The spring 45 is compressed between an end of the solenoid 30 and the enlarged head 411 of the puncher 40.

The security device 50 includes a groove 51 defined in a periphery and a plurality of elastic elements 52 formed on an end. The security device 50 is put in the shell 21. The retainers 24 of the halves 22 are inserted in the groove 51 of the security device 50 so as to retain the security device 50 in position.

Figure 2:
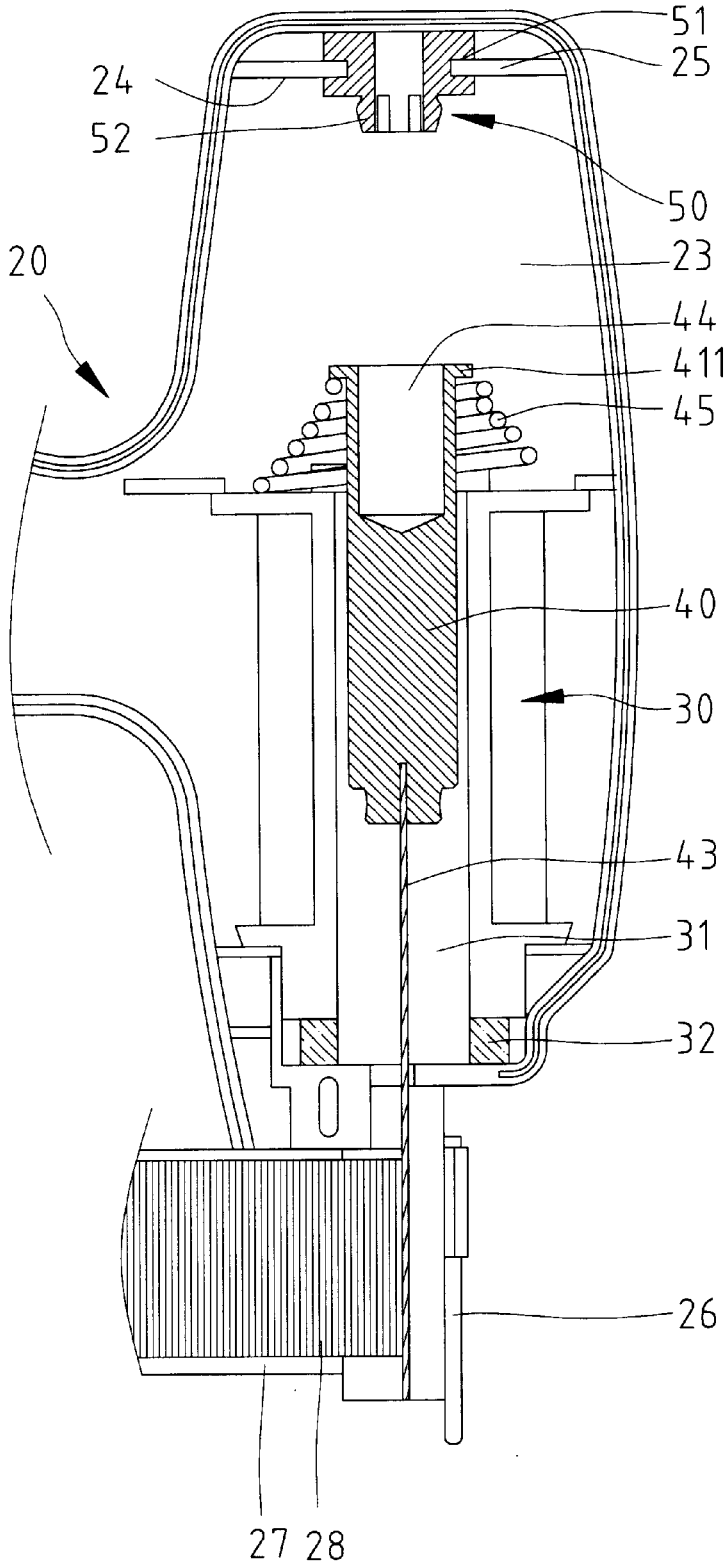
FIGS. 2–4 are cross-sectional views of the nail stapler in different positions.

Referring to FIG. 2, when activated, the solenoid 30 attracts the puncher 40 and therefore the pin 43 to move downwards so as to punch a staple nail 28 from the magazine 27 through an outlet 26. The spring 45 is compressed.

Figure 3:
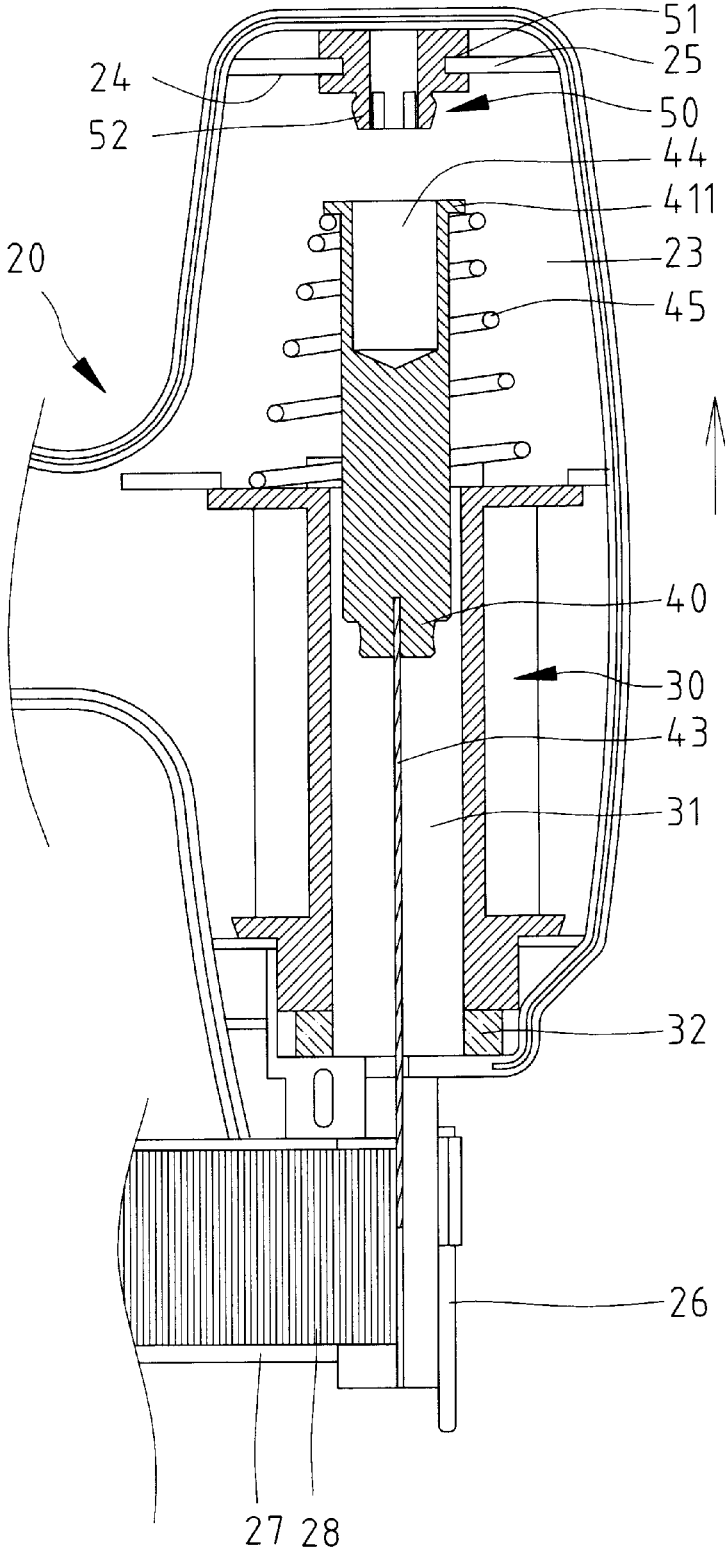

Referring to FIG. 3, when the magnetic force is gone, the puncher 40 resumes its original position due to the spring 45.

Figure 4:
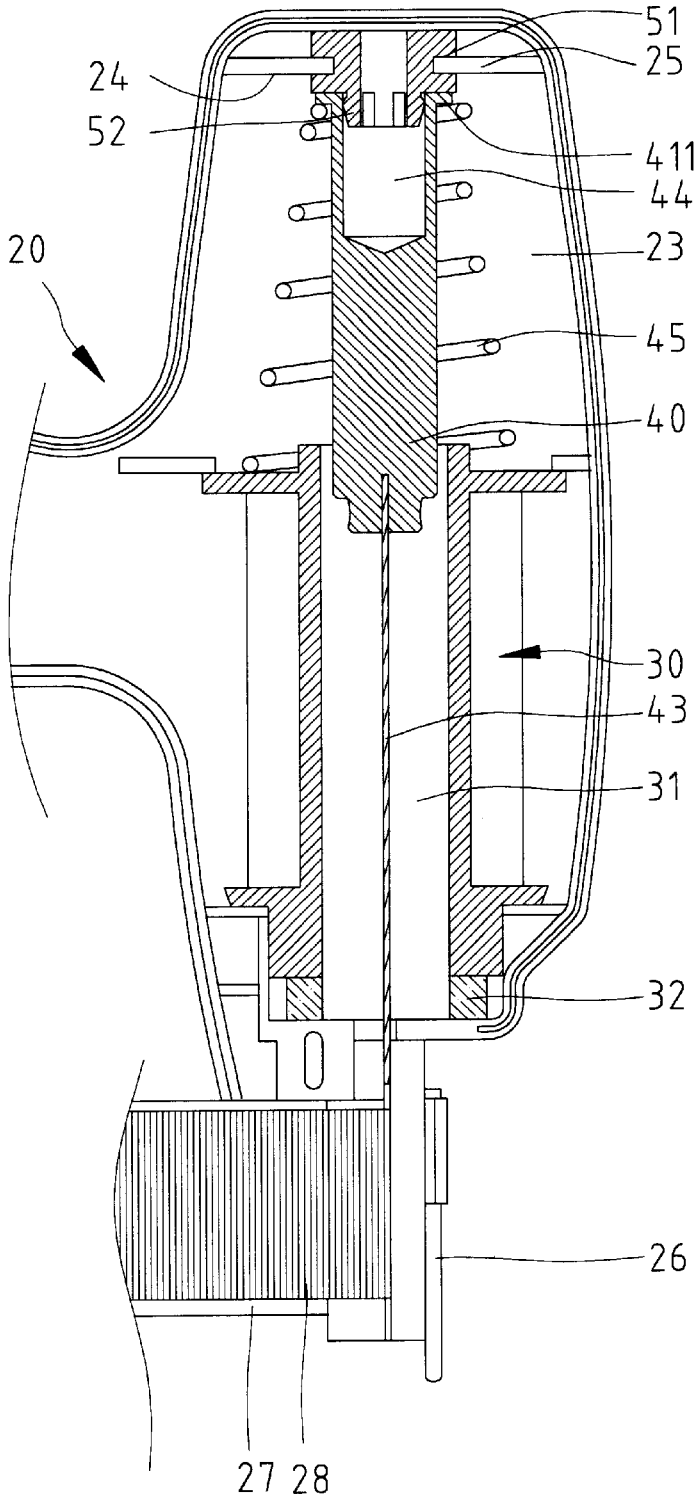
Figure 5:
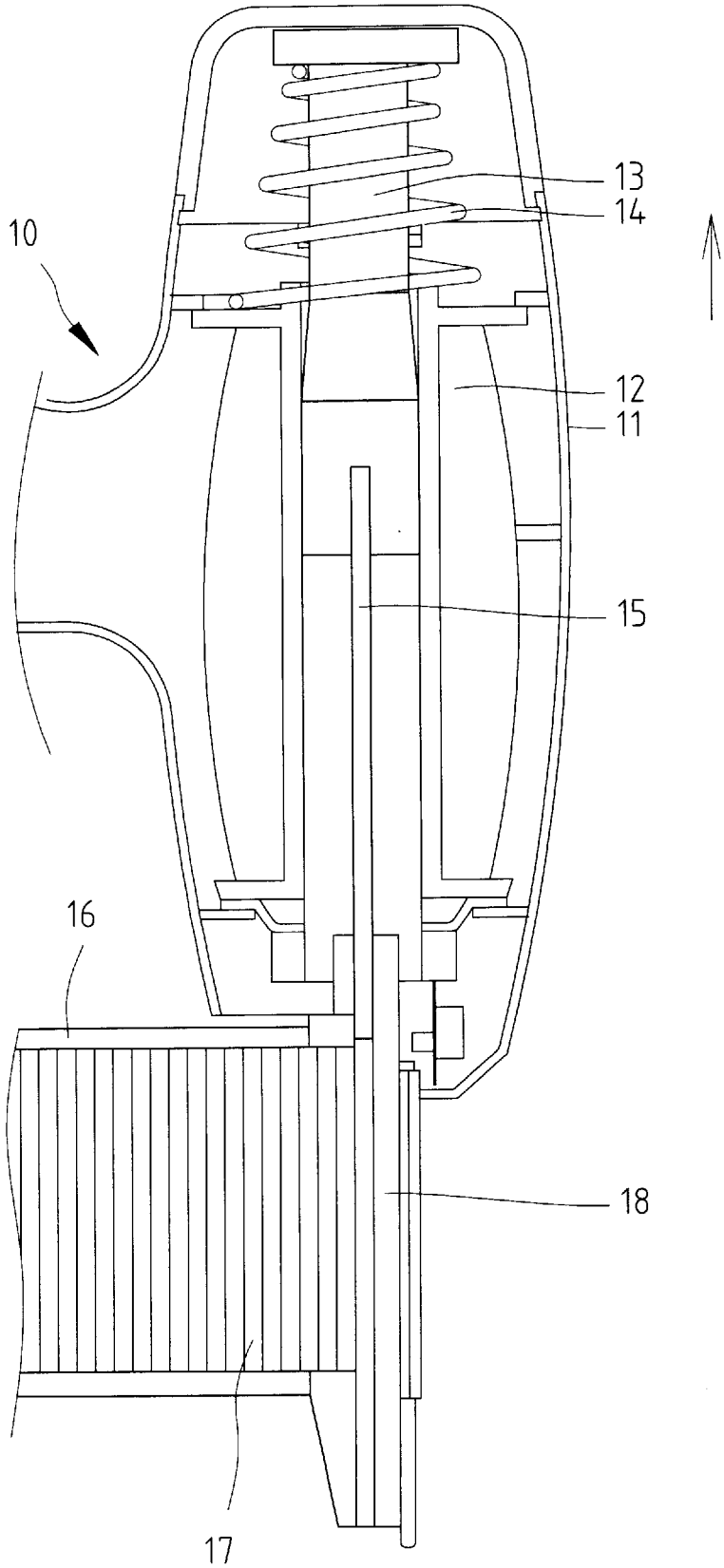
Fig. 5 PRIOR ART
FIGS. 5 and 6 are cross-sectional views of a nail stapler in different positions in accordance with prior art.
Figure 6:
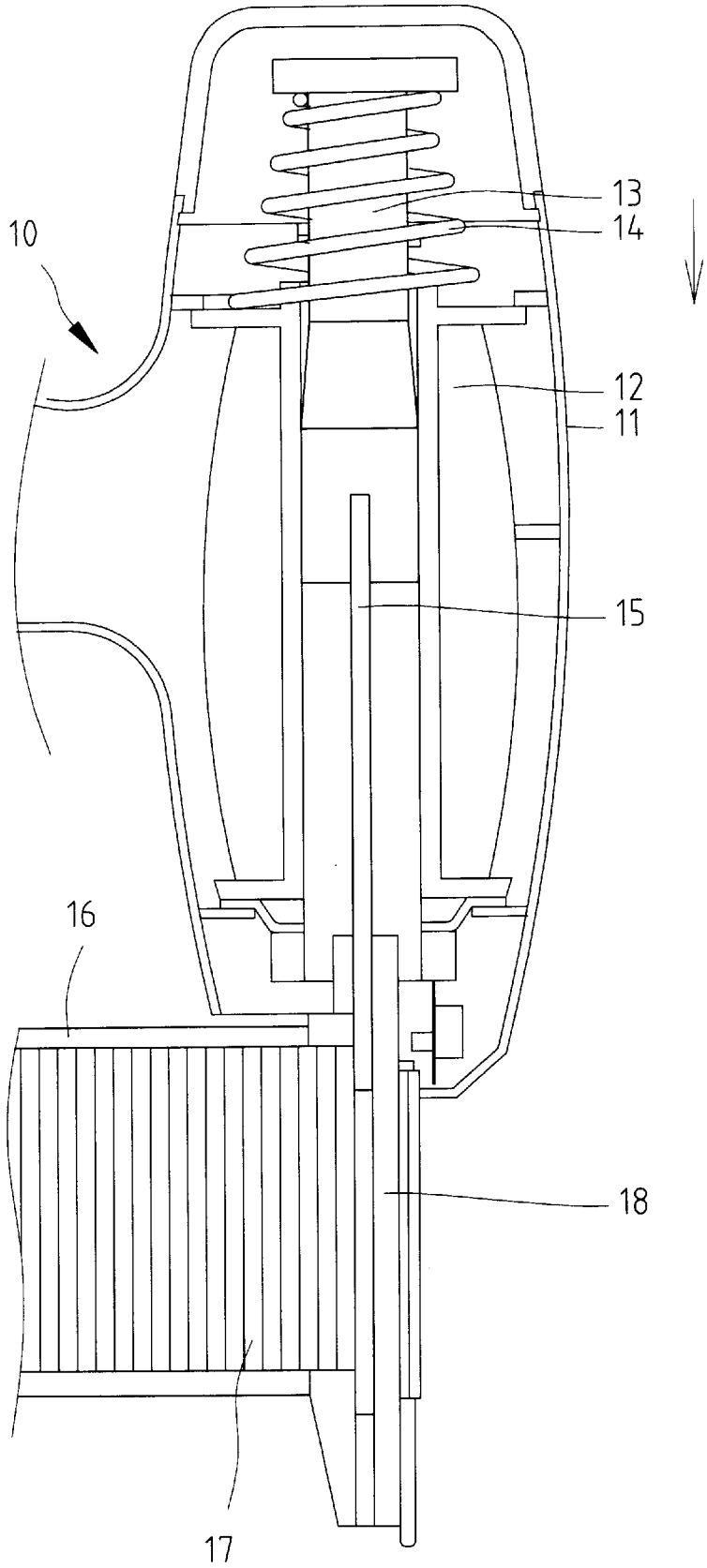
Fig. 6 PRIOR ART

Referring to FIG. 4, when the puncher 40 reaches its original portion, the elastic elements 52 of the security device 50 are inserted in the cavity 44 of the puncher 40. The elastic elements 52 of the security device 50 stretch out so as to contact the wall of the cavity 44 of the puncher 40. Thus, the puncher 40 does not hit and rebound from the retainer 24 to avoid punching a staple nail by mistake.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A nail stapler including:

a gun including a shell, a solenoid received in the shell, a puncher received in the shell and to be attracted from an original position to a punching position in a movement direction by the solenoid, a pin secured to the puncher and inserted through the solenoid, a spring compressed between a portion of the solenoid and a portion of the puncher, and a security device received in the shell for buffering the puncher when the puncher is pushed from the punching position to the original position by the spring; and a magazine for receiving and supplying staple nails to the gun, wherein the puncher defines a cavity with a wall for contact with the security device, wherein the security device includes an elastic end for contact with the puncher, wherein the elastic end of the security device includes a plurality of elastic elements, wherein the wall contacts the elastic elements.

2. The nail stapler according to claim 1 wherein the shell includes two halves, with each half including a retainer formed on an internal face, and wherein the security device defines a groove for receiving the retainers of the halves of the shell.

3. The nail stapler according to claim 1 with the wall of the cavity extending parallel to the movement direction.

4. The nail stapler according to claim 3 with the plurality of elastic elements stretching outward perpendicular to the movement direction to contact the wall of the cavity.

5. The nail stapler according to claim 4 with each of the plurality of elastic elements including an outer surface contacting the wall, with the outer surface being inclined to the movement direction and the wall.

6. The nail stapler according to claim 5 with the wall of the cavity having a shape in a plane perpendicular to the movement direction, with the plurality of elastic elements arranged in the shape and having spaces between adjacent elastic elements arranged in the shape.

7. The nail stapler according to claim 6 with the portion of the puncher comprising an enlarged head against which the spring is compressed, with the enlarged head being concentric around the cavity, with the enlarged head contacting the security device around the plurality of elastic elements.

8. A nail stapler including:

a gun including a shell a solenoid received in the shell, a puncher received in the shell and to be attracted from an original position to a punching position in a movement direction by the solenoid, a pin secured to the puncher and inserted through the solenoid, a spring compressed between a portion of the solenoid and a portion of the puncher, and a security device received in the shell for buffering the puncher when the puncher is pushed from the punching position to the original position by the spring; and a magazine for receiving and supplying staple nails to the gun, wherein the puncher defines a cavity with a wall for contact with the security device, wherein the security device includes an elastic end for contact with the puncher, wherein the elastic end of the security device includes a plurality of elastic elements, with the wall of the cavity having a shape in a plane perpendicular to the movement direction, with the plurality of elastic elements arranged in the shape and having spaces between adjacent elastic elements arranged in the shape.

9. The nail stapler according to claim 8 with the plurality of elastic elements stretching outward perpendicular to the movement direction.

10. The nail stapler according to claim 8 with the portion of the puncher comprising an enlarged head against which the spring is compressed, with the enlarged head being concentric around the cavity, with the enlarged head contacting the security device around the plurality of elastic elements.

11. A nail stapler including:

a gun including a shell, a solenoid received in the shell, a puncher received in the shell and to be attracted from an original position to a punching position in a movement direction by the solenoid, a pin secured to the puncher and inserted through the solenoid, a spring compressed between a portion of the solenoid and a portion of the puncher, and a security device received in the shell for buffering the puncher when the puncher is pushed from the punching position to the original position by the spring; and a magazine for receiving and supplying staple nails to the gun, wherein the puncher defines a cavity with a wall for contact with the security device, wherein the security device includes an elastic end for contact with the puncher, wherein the elastic end of the security device includes a plurality of elastic elements, with the plurality of elastic elements stretching outward perpendicular to the movement direction, with each of the plurality of elastic elements including an outer surface, with the outer surface being inclined to the movement direction, with the wall of the cavity having a shape in a plane perpendicular to the movement direction, with the plurality of elastic elements arranged in the shape and having spaces between adjacent elastic elements arranged in the shape.

12. The nail stapler according to claim 11 with the portion of the puncher comprising an enlarged head against which the spring is compressed, with the enlarged head being concentric around the cavity, with the enlarged head contacting the security device around the plurality of elastic elements.

13. A nail stapler including:

a gun including a shell, a solenoid received in the shell, a puncher received in the shell and to be attracted from an original position to a punching position in a movement direction by the solenoid, a pin secured to the puncher and inserted through the solenoid, a spring compressed between a portion of the solenoid and a portion of the puncher, and a security device received in the shell for buffering the puncher when the puncher is pushed from the punching position to the original position by the spring; and a magazine for receiving and supplying staple nails to the gun, wherein the puncher defines a cavity with a wall for contact with the security device, wherein the security device includes an elastic end for contact with the puncher, wherein the elastic end of the security device includes a plurality of elastic elements, with each of the plurality of elastic elements including an outer surface contacting the wall, with the outer surface being inclined to the movement direction and the wall.

14. The nail stapler according to claim 13 with the wall of the cavity having a shape in a plane perpendicular to the movement direction, with the plurality of elastic elements arranged in the shape and having spaces between adjacent elastic elements arranged in the shape.

15. The nail stapler according to claim 14 with the portion of the puncher comprising an enlarged head against which the spring is compressed, with the enlarged head being concentric around the cavity, with the enlarged head contacting the security device around the plurality of elastic elements.

16. A nail stapler including:

a gun including a shell, a solenoid received in the shell, a puncher received in the shell and to be attracted from an original position to a punching position in a movement direction by the solenoid, a pin secured to the puncher and inserted through the solenoid, a spring compressed between a portion of the solenoid and a portion of the puncher, and a security device received in the shell for buffering the puncher when the puncher is pushed from the punching position to the original position by the spring; and a magazine for receiving and supplying staple nails to the gun, wherein the puncher defines a cavity with a wall for contact with the security device, wherein the security device includes an elastic end for contact with the puncher, wherein the elastic end of the security device includes a plurality of elastic elements, with the portion of the puncher comprising an enlarged head against which the spring is compressed, with the enlarged head being concentric around the cavity, with the enlarged head contacting the security device around the plurality of elastic elements.

* * * * *